US005244490A

United States Patent [19]

Agarwal

[11] Patent Number: 5,244,490

[45] Date of Patent: Sep. 14, 1993

[54] IRON MAKING METHOD USING WASTE POLYMER MATERIAL

[75] Inventor: Kedar B. Agarwal, Troy, Mich.

[73] Assignee: General Motors Corporation, Detroit, Mich.

[21] Appl. No.: 879,596

[22] Filed: May 7, 1992

[51] Int. Cl.[5] ..... C21B 11/00

[52] U.S. Cl. ..... 75/500; 75/577; 75/581

[58] Field of Search ..... 75/500, 577, 581, 507, 75/571

[56] References Cited

U.S. PATENT DOCUMENTS

| | | | |
|---|---|---|---|
| 3,346,417 | 10/1967 | Ehrlich | 134/2 |
| 3,656,735 | 4/1972 | Eliot | 266/33.5 |
| 3,821,026 | 6/1974 | Swartz | 134/2 |
| 3,909,446 | 9/1975 | Miyashita et al. | 75/463 |
| 3,983,009 | 9/1976 | Neal et al. | 202/93 |
| 4,014,681 | 3/1977 | Rhinehart | 75/581 |
| 4,091,825 | 5/1978 | Baker | 134/2 |
| 4,175,949 | 11/1979 | Breznay | 75/471 |
| 4,412,889 | 11/1983 | Oeck | 202/117 |
| 4,439,209 | 3/1984 | Wilwerding et al. | 48/76 |
| 4,647,443 | 3/1987 | Apffel | 423/449 |
| 5,129,995 | 7/1992 | Agarwal | 201/21 |
| 5,198,018 | 3/1993 | Agarwal | 75/401 |

FOREIGN PATENT DOCUMENTS

| | | | |
|---|---|---|---|
| 2225610 | 9/1990 | Japan | 75/581 |
| 1403187 | 8/1975 | United Kingdom . | |

OTHER PUBLICATIONS

"Shrinking the Old-Tire Mountain: Progress Slow", The New York Times, May 9, 1990.

"Gas Injection-Lowers Cupola Melting Costs, Increases Melting Rates", Foundry, 1969.

AFS Cupola Handbook, 4th edition, 1975, pp. 2-3, 9-10, 22, 425.

*Primary Examiner*—Melvyn J. Andrews

*Attorney, Agent, or Firm*—Flynn, Thiel, Boutell & Tanis

[57] ABSTRACT

A method of making iron involves using waste polymer material as a solid fuel charged to an iron melting vessel and/or using gaseous decomposition products from pyrolysis of waste polymer material as a gaseous fuel supplied to the vessel. Relatively large quantities of waste polymer materials can thereby be disposed of without landfill usage, while a substantial portion of their energy value is recovered for heating and melting the iron-bearing material in the vessel. The waste polymer material may comprise reaction injection molding compounds and precursors thereof, sheet mold compounds and precursors thereof, car fluff (i.e., non-metallic residue from the recycling of automobiles), scrap rubber tires and the like. Waste sheet molding compounds including calcium carbonate filler can be charged to the iron-making vessel such that the calcium carbonate therein is released and functions as a flux at the iron-making temperature involved to remove impurities from the iron. As a result, limestone additions to the vessel can be reduced or eliminated.

16 Claims, 1 Drawing Sheet

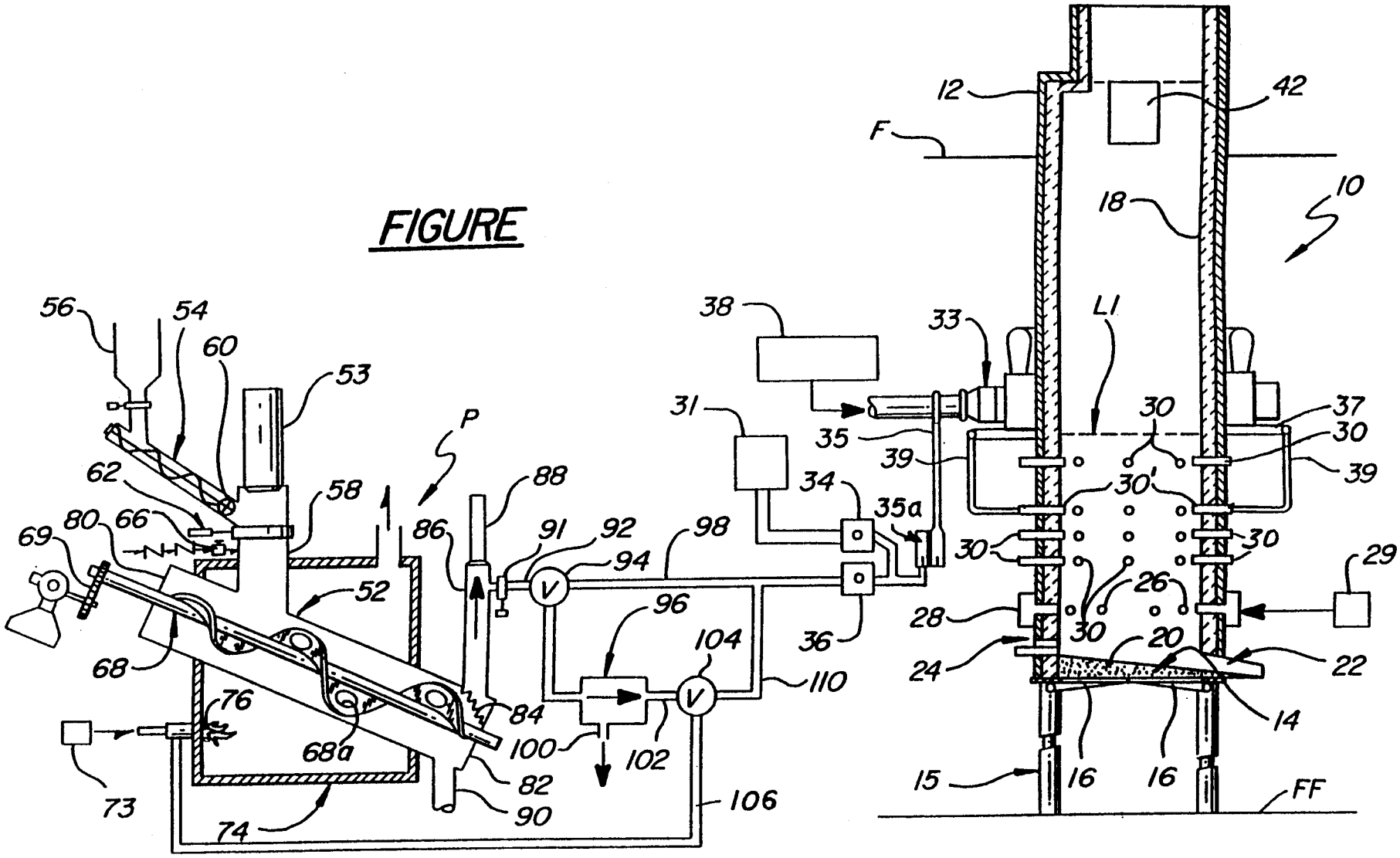
FIGURE

IRON MAKING METHOD USING WASTE POLYMER MATERIAL

FIELD OF THE INVENTION

The present invention relates to a method of making iron in an iron-making vessel using waste polymer material as a solid fuel charged to the vessel and/or gaseous decomposition products from the pyrolysis of waste polymer material as a gaseous fuel supplied to the vessel for heating and melting an iron-bearing charge therein. The invention also relates to use of waste polymer which includes $CaCO_3$ filler in an iron-making method in lieu of some or all of a limestone charge.

BACKGROUND OF THE INVENTION

Polymer waste (scrap) materials containing a substantial volume of an inorganic filler component are typically disposed of via land fill. Such polymer waste materials have included filled/unfilled thermoset/thermoplastic polymers, exemplary of which are reinforced reaction injection molded (RRIM) theromset plastic materials having a urethane organic component as well as unreacted precursors (e.g., polyols and isocyanates) of the RRIM polymer; sheet molding compounds (SMC) having a styrene cross-linked polyester organic component; uncured SMC reactants (commonly called "purged SMC)" comprising styrene and unsaturated polyesters; and such epoxies, phenolics, silicates, melamines, diallylphthalates, and polyimides as are typically used in reinforced plastics. The polymer waste material also includes used (scrap) vehicle tires and car fluff which comprises the residue of a scrap vehicle after being processed to remove metal (e.g., steel, iron, copper, aluminum). Car fluff typically comprises approximately 50–60 weight % organics and the balance inorganics such as mostly rust (e.g., 35–40 weight %), glass, grid and dirt.

Disposal of such waste polymer materials by land fill is fraught with environmental problems relating to a lack of land fill space and the inability of polymers to rapidly degrade at the land fill site. Moreover, land fill disposal of such polymer waste materials can be costly as a result of transportation and handling costs involved and as a result of disposal fees charged for certain waste polymer material. For example, disposal of used tires at a land fill site in the state of Michigan requires a disposal fee of one dollar per tire, whereas disposal of used tires in the state of Minnesota requires a disposal fee of five dollars per tire.

A known alternative to disposing of such waste polymer material by land fill involves pyrolyization to volatize the organic component from the inorganic component of the material. Pyrolysis is the thermal decomposition of organic matter at temperatures sufficient to volatize or gasify organic matter in the feed in the absence of oxygen or any oxidizing agent. Copending U.S. application Ser. No. 07/655,920, now U.S. Pat. No. 5,129,995 entitled PYROLYSIS PROCESS AND APPARATUS and of common assignee herewith describes a continuous pyrolysis apparatus and method for recovering the inorganic component from such waste polymer materials for reuse in the manufacture of like material and the organic component as gaseous decomposition products for use in fueling the pyrolysis apparatus; i.e., for combustion in the burner of the pyrolysis apparatus.

In view of the ever increasing amount of waste polymer materials generated by a wide variety of industries throughout the world, there is a need for disposal of large quantities of such waste materials in an environmentally acceptable and cost effective manner. Disposal of such waste materials in a manner that can recover at least some of their energy value would be highly advantageous and desirable to reduce energy demand.

It is an object of the present invention to provide a method of making iron wherein solid waste polymer material is charged to an iron-making vessel for combustion of the waste polymer material therein as a substitute for more costly fuel that would otherwise be required to heat and melt an iron-bearing material in the vessel, whereby the waste polymer material is disposed of while recovering at least some of its heat (energy) value.

It is another object of the present invention to provide a method of making iron wherein waste polymer material containing a calcium carbonate filler is charged to an iron-making vessel for combustion of the waste polymer material therein as a substitute for more costly fuel that would otherwise be required to heat and melt an iron-bearing material in the vessel and also to release the calcium carbonate for participation in the iron-making method as a flux for removing impurities from the iron melt, whereby the waste polymer material is disposed of while recovering at least some of its heat (energy) value and reusing the calcium carbonate therein for fluxing purposes.

It is still another object of the present invention to provide a method of making iron wherein at least a portion of the fuel burned to heat and melt an iron-bearing charge material in an iron-making vessel comprises gaseous decomposition products from pyrolysis of waste polymer material, whereby the waste polymer material is disposed of while recovering at least some of its heat (energy) value.

SUMMARY OF THE INVENTION

The present invention contemplates a method of making iron in a vessel using solid waste polymer material as a solid fuel charged to the vessel and/or using gaseous decomposition products from pyrolysis of waste polymer material as a gaseous fuel supplied to the vessel. In accordance with one embodiment of the present invention, a solid iron-bearing material is charged (introduced) to the vessel, solid waste polymer material is charged to the vessel, and fuel is supplied to the vessel for combustion therein along with the waste polymer material to heat the iron-bearing material to a temperature to form molten iron. The waste polymer material provides a fuel source that substitutes for some of the fuel otherwise required to heat and melt the iron-bearing material. The waste polymer material is thereby disposed of while at least some of its energy value is recovered.

The waste polymer material may comprise reaction injection molding compounds and precursors thereof, sheet molding compounds and precursors thereof, car fluff (i.e., non-metallic residue from the recycling of automobiles), scrap rubber tires, and the like. The waste sheet molding compounds and precursors thereof are a preferred solid charge constituent by virtue of their including calcium carbonate filler. In particular, upon combustion of the organic component of the sheet molding compound in the vessel, the calcium carbonate is released and functions as a flux at the iron-making temperature involved to remove impurities from the molten iron. As a result, limestone additions to the vessel can be reduced or eliminated.

In another embodiment of the present invention wherein a solid iron-bearing material is introduced to an iron-making vessel and heated to a molten state by combusting a fuel in the vessel, at least a portion of the fuel comprises combustible gaseous decomposition products from pyrolysis of waste polymer material. Preferably, the pyrolytic combustible gaseous decomposition products supplied to the vessel include condensable and non-condensable gaseous organic materials providing maximum heat (energy) content. Waste polymer material is thereby disposed of while a substantial portion of its energy value is recovered for use in heating and melting the iron-bearing material in the iron-making vessel.

The gaseous decomposition products from the pyrolyzed waste polymer material can be substituted for some or all of more costly natural gas used to heat the vessel charge, thereby reducing the cost to make a given amount of iron. The gaseous decomposition products can also be substituted for some or possibly all of any coke present with the solid iron-bearing charged to the vessel to further reduce the cost of making the iron as well as to enable higher iron production rates to be realized.

In practicing the present invention, the iron-making material charged to the vessel may comprise scrap iron/steel/pig iron typically used in a foundry cupola iron-making process for producing cast iron. Alternately, the iron-making material may comprise iron ore (e.g., taconite or raw ore) typically used in a blast furnace process for producing pig iron. The present invention is not limited to these iron-making processes, however.

Other objects and advantages of the present invention will be readily appreciated as the same becomes better understood by reference to the following detailed description thereof considered in connection with the accompanying drawings wherein:

DESCRIPTION OF THE DRAWINGS

The Figure is a schematic view of an iron-melting vessel and pyrolysis apparatus for practicing one embodiment of the method of the invention.

DETAILED DESCRIPTION OF THE INVENTION

Referring to the Figure, a shaft-type iron-melting vessel (e.g., a cupola) 10 for practicing one embodiment of the method of the invention is illustrated. The vessel 10 comprises a cylindrical, upstanding support shell 12 typically fabricated from rolled steel plates joined together by welding, riveting, bolting or other fastening techniques. A hearth 14 is formed at the bottom of the shell 12 by one or more cast iron or steel bottom plates 16. The shell 12 is lined with a refractory brick liner 18 whereas the bottom plate 16 is covered with a refractory sand layer 20 in accordance with conventional cupola practice. The vessel 10 is supported on a support structure 15 mounted on the foundry floor FF as shown.

An iron tap hole 22 and a slag tap hole 24 are formed above the hearth 14 in conventional manner to enable removal of molten iron and slag, respectively, from the vessel 10. The iron tap hole 22 is below the slag tap hole 24 in accordance with conventional practice. The iron and slag tap holes 22,24 may remain open so that the molten iron and the slag are continuously discharged as they are formed during the iron making process. Alternately, the iron and slag tap holes 22,24 may be blocked initially by suitable removable refractory plugs (not shown) that remain in place until selected quantities of the slag and molten iron accumulate in the vessel 10.

A plurality of circumferentially spaced apart tuyeres 26 are provided in the shell 12 and the liner 18 at a level above the iron and slag tap holes 22,24 for introduction of combustion air to the vessel 10. The tuyeres 26 are located above the normal slag level in the vessel 10 during the iron-making operation and at a region of the vessel 10 initially filled with a bed of coke (not shown but see dashed line L1 designating the upper level of the initial coke bed). The tuyeres 26 receive combustion air from an annular air manifold 28 (wind box) disposed about the shell 12. The air manifold 28 is supplied with air by a suitable air blower 29.

A plurality of circumferentially spaced apart burners 30 are provided in the shell 12 and the liner 18 at multiple levels above the tuyeres 26 for combustion of a combustion air/gaseous fuel mixture in the vessel 10. The gaseous fuel may comprise natural gas supplied from a conventional source 31 (e.g., a natural gas supply line) and/or combustible gaseous decomposition products from pyrolysis of waste polymer material in a pyrolysis apparatus P to be described hereinbelow. The burners 30 are located in the aforementioned region of the vessel 10 initially filled with the coke bed (see dashed line L1 designating the upper level of the coke bed).

The gaseous fuel is supplied from the source 31 and/or the pyrolysis apparatus P via a supply conduit 35 to a premix manifold 33 where the gas is mixed with combustion air supplied by air blower 38. The conduit 35 includes a manual or automatic gas switching valve 35*a*. The gas/air mixture is supplied to the burners 30 from an annular manifold 37 communicated to the premix manifold 33. The manifold 37 is connected to supply conduits 39 each communicating to a respective burner 30 for supplying the gas/air mixture thereto. For the sake of clarity and convenience, supply conduits 39 are shown only for burners 30' in the Figure. The other burners 30 receive the gas/air mixture via like supply conduits 39 (not shown). The air/gas mixture supplied to the burners 30 typically comprises a 6:1 to 14:1 ratio of air to gaseous fuel.

The flow rates of the natural gas and/or gaseous decomposition products are controlled by respective conventional gas metering devices 34,36.

The vessel 10 is charged with solid iron-making charge materials through a charging door 42 proximate the upper end of the vessel. Typically, the charging door 42 is accessible via an upper, charging floor F of the foundry. In preparation for operation of the vessel 10, refractory sand is introduced through the door 42 to form the sand layer 20 on the bottom plate(s) 16 to a level of about 9 inches. The sand layer 20 is formed so as to taper downwardly toward the iron tap hole 22 to facilitate molten iron removal from the vessel. Thereafter, the coke bed is formed atop the sand layer 20 by introducing chunks or briquettes (e.g., 10 inches wide by 12 inches long by 8 inches thick) of coke through the door 42 to provide a coke bed height of about 6 feet (see line L1). The coke bed provides initial support for the solid iron-making charge materials to be subsequently introduced through the door 42 to the vessel 10 and functions as a fuel source during initial operation of the vessel 10. However, the coke bed is eventually consumed over time during the iron-making operation.

The present invention involves using solid waste (scrap) polymer material as a constituent of the solid iron-making charge introduced to the vessel 10 onto the coke bed and/or using combustible gaseous decomposition products from pyrolysis of solid waste (scrap) polymer material as a gaseous fuel supplied to the burners 30 of the vessel 10. Waste polymer materials useful in practicing the invention include filled and unfilled thermoset/thermoplastic polymers. Examples of filled polymers materials are reinforced reaction injection molded (RRIM) thermoset plastic materials which have an organic component comprising substantially polyurethanes; unreacted precursors of the RRIM polymer such as polyols and isocyanates; sheet molding compounds (SMC) which have an organic component comprising styrene cross-linked polyesters; uncured SMC reactants (commonly called "purged SMC") comprising styrene and unsaturated polyesters, car fluff; and such epoxies, phenolics, silicates, melamines, diallylphthalates, and polyimides as are typically used in reinforced plastics. The RRIM material typically includes about 15 weight % glass in a polyurethane matrix. The SMC material typically includes about 48 weight % calcium carbonate ($CaCO_3$) and about 27 weight % glass as an inorganic filler in a styrene cross-linked polyester matrix. The balance of the SMC material comprises about 25 weight % organic resins.

Exemplary of useful waste unfilled polymer materials are reaction injection molded (RIM) plastics, such as unreinforced RIM polyurethanes and polyureas.

Scrap rubber tires that are shredded or otherwise comminuted may comprise filled or unfilled waste polymer materials useful in practicing the invention, depending upon whether the tires are of the steel or glass belt reinforced type. The organic component of the tires typically comprises a copolymer of butadiene and styrene while the inorganic component comprises the steel or glass material of the reinforcing belts.

The waste polymer materials typically are shredded or otherwise comminuted into chunks before charging to the vessel 10 (e.g., 4 inch wide by 4 inch long pieces of SCM sheet scrap).

For purposes of illustration and not limitation, the present invention will be described hereinbelow with respect to making a particular cast iron melt in the vessel 10. To this end, the vessel is charged with an iron-making charge comprising scrap iron/steel/pig iron as iron-bearing materials. The iron-making charge also includes coke primarily as a source of carbon for controlling the carbon content of the iron melt to the desired level and secondarily as a fuel source. The coke constituent of the iron-making charge is optional if the carbon content of the iron melt can be otherwise controlled at the desired level. The iron-making charge further includes one or more of the aforementioned solid waste polymer materials as a solid charge constituent for combustion in the vessel 10 as a fuel source that substitutes for some of the gaseous fuel that otherwise would be supplied to the gas burners 30. The aforementioned SMC waste polymer material is advantageous as a charge constituent in that it contains calcium carbonate (48 weight % $CaCO_3$) which is released by combustion of the SMC material in the vessel and functions at the iron-making temperature involved to fluidize the slag formed during iron melting and to flux impurities from the iron melt.

For example, in order to make a cast iron melt having a composition of 3.2–3.5 weight % C, 1.8–2.2 weight % Si, 0.4–0.7 weight % Mn, 0.05 weight % P, 0.08–0.12 weight % S, and the balance Fe in the vessel 10, the iron-making charge comprises 600 lbs. scrap iron, 600 lbs. scrap steel, 300 lbs. scrap pig iron, 170–216 lbs. coke chunks (of the same size as used for the aforementioned coke bed), and 110–150 lbs. waste SMC material (e.g., 4 inches wide by 4 inches long pieces of SCM sheet scrap). Limestone ($CaCO_3$) is not included in the iron-making charge since the $CaCO_3$ of the SMC waste material will provide the quantity (i.e., 52–72 lbs. $CaCO_3$) required for slag fluidization and impurity fluxing purposes.

These charge constituents are pre-weighed and introduced to the vessel 10 (diameter of 6 feet) through the charging door 42 as discrete layers wherein the scrap iron/steel/pig iron constituent is introduced as a first layer, the coke constituent is introduced as a second layer, and the waste SMC constituent is introduced as a third layer. The charge constituents are introduced in this sequence to a level or height about 3 inches below the charging door 42.

Following charging of the vessel 10, the air blower 29 is actuated to introduce combustion air to the vessel 10 via the tuyeres 26. Combustion air is supplied to the tuyeres 26 at about 4400 cubic feet per minute by the blower 29. A combustion air/natural gas mixture (e.g., typical air to gas ratio of 10:1) is burned at the burners 30 at a rate to provide molten iron at a typical temperature of about 2800° F. to 3000° F. proximate the bottom of the vessel.

Under these conditions of operation, molten cast iron begins to flow from the iron tap hole 22 after about 30 minutes. As the charge materials in the vessel 10 descend toward the hearth 14 during operation, additional pre-weighed charge constituents (described hereinabove) are charged to the vessel 10 through the door 42 in 5 minute intervals in the sequential order described hereinabove. Continuous operation of the vessel 10 is thereby effected to provide a molten cast iron output of about 9–10 tons per hour. The molten cast iron and slag are continuously discharged from the respective iron and slag tap holes 22,24 during operation of the vessel 10.

In operation of the melting vessel 10 in the manner described, the waste polymer material constituent of the iron-making charge (e.g., the SMC material in the specific iron-making charge described above) provides a fuel source that substitutes for some of the natural gas fuel supplied to the gas burners 30 and that would otherwise be required to heat and melt the iron-bearing material (scrap iron/steel/pig iron). The waste polymer material is thereby effectively disposed of while a substantial portion of its heat (energy) value is recovered. Moreover, when the waste polymer material comprises SMC scrap, the calcium carbonate filler therein is released by combustion of the SMC scrap in the vessel 10 and functions as a flux at the iron-making temperature involved to fluidize the slag and remove impurities from the iron. As a result, limestone additions to the vessel 10 can be eliminated, or at least reduced. Use of the waste polymer material as a constituent of the solid iron-making charge to the vessel 10 thus reduces the cost of making the iron melt while disposing of the waste polymer material in a manner that recovers much of its heat value and that avoids land fill usage.

Still further cost and waste polymer material disposal benefits can be achieved in accordance with a further embodiment of the invention wherein some or all of the natural gas fuel supplied to the gas burners 30 during the iron melting operation is replaced by combustible gaseous decomposition products from the pyrolysis of waste polymer material.

In particular, waste (scrap) polymer materials of the same type as described hereinabove (e.g., RRIM, RIM, SCM, precursors thereof, rubber tires, car fluff, etc.) are pyrolyzed in a pyrolysis apparatus P, which preferably is of the type described in allowed copending U.S. application Ser. No. 07/655,920 of common assignee herewith, the teachings of which are incorporated herein by reference.

Such a pyrolysis apparatus P includes a reactor housing (retort) 52 having a screw type mechanical conveyor 54 for transferring solid waste polymer feed material from a feed hopper 56 to an inlet 58 of the reactor housing. The waste polymer feed material passes through a rotary air lock 60 and a gate valve 62 prior to entering the inlet 58. The air lock 60 prevents air from entering the reactor housing 52. A plunger 53 may be positioned for movement in the inlet 58 and periodically actuated downwardly to clear any solid material restricting or accumulating in the inlet 58.

The inlet 58 includes an inert gas inlet valve 66 connected thereto for introducing an inert gas to the reactor housing 52. Prior to feeding the waste polymer feed material from the hopper 56 to the inlet 58 and prior to heating the reactor housing 52, air is purged from the reactor housing by introducing the inert gas (e.g., nitrogen) via the inert gas valve 66 to flood the interior of the housing 52. The pyrolysis reaction is carried out in the absence of oxygen so as to avoid potentially dangerous rapid oxidation and the potential formation of toxic gases depending on the composition of the waste polymer feed material.

After purging of the reactor housing with the inert gas, the reactor housing 52 is heated to a temperature sufficient to pyrolyze the waste polymer feed material by a furnace assembly 74 having a gas burner 76 which preferably burns a gaseous organic fuel. The temperature required for pyrolyization will depend upon the composition of the waste polymer feed material being conveyed through the reactor housing 52. It is desirable to operate the reactor housing 52 at a temperature of about 75° F. above the vaporization temperature of the organic component of the waste feed material. Operation at such a temperature minimizes charring of the organic component and hence the amount of carbon contamination on the solid residue resulting from pyrolyization. For example, a suitable pyrolysis temperature for waste SMC material will typically be 1300° F. plus or minus 50° F. For the waste RRIM material, a suitable pyrolysis temperature will be 1450° F. plus or minus 50° F.

The burner 76 is initially fired by natural gas supplied from a suitable source 73 (e.g., a natural gas line). The burner 76 is subsequently fired with recovered pyrolytic gaseous decomposition products (e.g., non-condensible pyrogases) from the reactor housing 52 once the pyrolysis reaction is initiated. Thereafter, the pyrolysis reaction will generate the fuel required by the burner 76. A self sufficient energy pyrolysis process is thereby provided.

A screw-type conveyor 68 rotated by drive assembly 69 progressively moves the waste polymer feed material slowly through the reactor housing 52 where it is progressively volatized or gasified and decomposed over a period of about 20 minutes to about 30 minutes. The conveyor 68 includes apertures **68*a* to allow gaseous decomposition products to escape from the feed material. The waste polymer feed material progressively changes from a polymer-rich material at the entrance end 80 of the reactor housing 52 to an essentially polymer-free residue at the exit end 82 of the reactor housing. The recoverable gaseous decomposition products pass through a filter or screen 84 to a gas outlet 86 at the exit end 82 of the reactor housing. The filter or screen 84 prevents any solid, polymer-free residue from passing to the gas outlet 86. A plunger 88 may be disposed in the gas outlet 86 and are periodically actuated downwardly (with the filter or screen 84 removed) to clear the outlet 86** of solid material restrictions or accumulations therein.

The polymer-free residue will comprise substantially the inorganic fillers of the waste polymer feed material. At the exit end 82 of the reactor housing 52, the solid, polymer-free residue from the pyrolysis reaction is discharged to a residue outlet 90 for further treatment in cooling and oxidation chambers (not shown) to remove carbon residue therefrom in accordance with the teachings of the aforementioned copending U.S. application Ser. No. 07/655,920. The cooling/oxidation chambers and treatment of the solid residue exiting the outlet 90 form no part of the present invention and thus will not be described in detail.

The combustible organic gaseous decomposition products generated from the pyrolysis reaction in the reactor housing 52 include condensable and non-condensable gaseous organic materials. The gaseous decomposition products exit the reactor housing 52 through the outlet 86 and gate valve 91 and travel via a suitable conduit 92 to a distribution valve 94 where a portion of the gaseous decomposition products is directed to a gas separation assembly device 96 and the remaining portion of the gaseous decomposition products is sent directly via a conduit 98 to the second gas metering valve 36 in the vicinity of the vessel 10. The gas metering valve 36 controls the flow rate of the gaseous decomposition products from the pyrolysis apparatus P and the gas separation assembly 96.

The gas separation assembly 96 separates the condensable gaseous organic material from the non-condensable gaseous organic material by condensing the former to a liquid (referred to as pyro oil) for discharge to a drain line 100. Thus, only the non-condensable gaseous organic material (referred to as pyrogas) exits the gas separation assembly 96 via the exit conduit 102. The gas separation assembly 96 is described in detail in the aforementioned copending U.S. application Ser. No. 07/655,920. A desired quantity of the pyrogas in conduit 102 can be recycled by a distribution valve 104 through a conduit 106 to the burner 76 of the reactor housing 52 where the pyrogas is burned to provide heat to effect the pyrolysis reaction in the reactor housing 52.

The remainder of the pyrogas can be directed through conduit 110 to the conduit 98 for mixing with the untreated (uncondensed) gaseous decomposition products including both the condensable and non-condensable gaseous organic materials for supply to the premix manifold 33 of the vessel 10.

Since the gaseous decomposition products including the condensable and non-condensable gaseous organic materials have more heat value than the pyrogas exiting the gas separation assembly 96, it is preferred to supply as large a portion of the untreated gaseous decomposition products as possible directly from the pyrolysis apparatus P to the burners 30 (i.e., bypassing the gas separation assembly 96). This maximizes the heat (energy) value of the combustible gaseous decomposition products supplied for combustion in the iron-making vessel 10.

The combustible gaseous decomposition products supplied from the pyrolysis apparatus P may comprise a selected proportion of the total gaseous fuel flow supplied to the burners 30 of the iron-making vessel 10 a determined by suitable control of the metering valves 34,36. Alternately, if sufficient quantities of the gaseous decomposition products can be generated in the pyrolysis apparatus P, they can be used as the sole source of gaseous fuel supplied to the burners 30. In any event, substitution of the gas decomposition products from the pyrolysis of the waste polymer material for some or all of the natural gas supplied from the source 31 to the burners 30 will reduce the amount of the more expensive natural gas required to heat and melt the iron-making charge in the vessel 10.

Moreover, use of the pyrolytic gaseous decomposition products and/or the natural gas from the source 31 will reduce the quantity of coke particulates required in the solid iron-making charge introduced to the vessel 10 through the door 42 and will enable higher iron production rates to be realized.

The cost of making a given amount of molten iron is thereby reduced. Maximum cost savings are realized when the pyrolytic gaseous decomposition products are supplied to the premix manifold 33 in lieu of all of the natural gas since the gaseous decomposition products are substantially lower in cost than natural gas purchased on the open market.

Although the present invention is illustrated hereinabove with respect to the melting of scrap iron/steel/pig iron in the vessel 10 to produce cast iron, the invention is not so limited. The invention can be practiced using other iron making processes such as, for example, blast furnace type processes wherein the solid charge to the blast furnace vessel includes iron ore (e.g., taconite or raw ore) and coke (or coal in certain recently developed blast furnace processes) and wherein the iron ore is reduced to molten pig iron by upwardly flowing reducing gases (e.g., CO) generated in the blast furnace. The present invention is not limited to any particular iron-making process, however.

The invention has been described in an illustrative manner, and it is understood that the terminology which has been used is intended to be in the nature of words of description rather than of limitation. Modifications and variations of the present invention are possible in light of the above teachings. It is, therefore, to be understood that within the scope of the appended claims the invention may be practiced otherwise than as specifically described.

I claim:

1. A method of making molten iron in a vessel, comprising the steps of introducing a solid iron-bearing material to the vessel, introducing waste polymer material including calcium carbonate filler therein to the vessel, supplying fuel to the vessel for combustion, and combusting the fuel and the waste polymer material in the vessel to heat and melt the iron-bearing material, whereby combustion of said waste polymer material reduces the amount of fuel otherwise required to heat and melt the iron-bearing material and releases calcium carbonate for fluxing the melted iron in said vessel.

2. The method of claim 1 including supplying a combustible gaseous fuel to the vessel as said fuel.

3. The method of claim 2 further including pyrolytically decomposing waste polymer material to form combustible gaseous decomposition products and supplying said gaseous decomposition products to said vessel as said combustible gaseous fuel for combustion.

4. The method of claim 1 wherein the iron-bearing material is selected from the group consisting of scrap iron, scrap steel, pig iron, and iron ore.

5. The method of claim 1 wherein the waste polymer material comprises a sheet molding compound and/or a precursor thereof which have mixed organic and inorganic components wherein the inorganic component comprises calcium carbonate that is released upon combustion of the organic component in the vessel for fluxing the melted iron to remove impurities therefrom.

6. The method of claim 1 wherein the waste polymer material also comprises a reaction injection molding material and/or a precursor thereof.

7. A method of making molten iron in a vessel, comprising the steps of introducing a solid iron-bearing material to the vessel, introducing waste polymer material to the vessel, supplying fuel to the vessel for combustion wherein at least a portion of said fuel comprises combustible gaseous decomposition products obtained by pyrolyzing other waste polymer material in a pyrolysis apparatus separate from said vessel and wherein said combustible gaseous decomposition products are introduced from said pyrolysis apparatus directly to the iron-making vessel via burner mean son said vessel for combustion therein, and combusting the fuel and the waste polymer material in the vessel to heat and melt the iron-bearing material, whereby combustion of said waste polymer material and said combustible gaseous decomposition products reduces the amount of fuel otherwise required to heat and melt the iron-bearing material.

8. A method of making molten iron in a vessel, comprising the steps of introducing to the vessel a charge comprising solid iron-bearing material and waste polymer material including calcium carbonate filler therein, supplying a combustible gaseous fuel to the vessel for combustion wherein at least a portion of the fuel comprises gaseous decomposition products resulting from pyrolysis of waste polymer material, and combusting the fuel and the waste polymer material of said charge to heat and melt said iron-bearing material, combustion of said waste polymer material releasing calcium carbonate for fluxing impurities from the melted iron in said vessel.

9. The method of claim 8 wherein the iron-bearing material is selected from the group consisting of scrap iron, scrap steel, pig iron and iron ore.

10. The method of claim 8 wherein the waste polymer material of said charge comprises a sheet molding compound and/or a precursor thereof which have an organic component selected from the group consisting of polyesters and styrene.

11. A method of making molten iron in a vessel, comprising the steps of introducing a solid iron-bearing material to the vessel and heating the iron-bearing material to a molten state by combusting a fuel in the vessel wherein at least a portion of said fuel comprises combustible gaseous decomposition products obtained by pyrolyzing other waste polymer material in a pyrolysis apparatus separate from the iron-making vessel and wherein said combustible gaseous decomposition products are introduced from said pyrolysis apparatus directly to the iron-making vessel via burner means of said vessel for combustion therein.

12. The method of claim 11 wherein the gaseous decomposition products include condensable and non-condensable organic gaseous materials.

13. The method of claim 11 wherein the gaseous decomposition products are formed by pyrolyzing waste sheet molding compound and/or a precursor thereof.

14. The method of claim 11 wherein the gaseous decomposition products are formed by pyrolyzing waste reaction injection molding material and/or a precursor thereof.

15. The method of claim 11 wherein the gaseous decomposition products are formed by pyrolyzing waste rubber tire material.

16. The method of claim 11 wherein the gaseous decomposition products are formed by pyrolyzing car fluff.

* * * * *

UNITED STATES PATENT AND TRADEMARK OFFICE

CERTIFICATE OF CORRECTION

PATENT NO. : 5,244,490

DATED : September 14, 1993

INVENTOR(S) : Kedar B. AGARWAL

It is certified that error appears in the above-identified patent and that said Letters Patent is hereby corrected as shown below:

Column 10, line 36; replace "mean son" with ---means on---.

Signed and Sealed this

Twelfth Day of April, 1994

*Attest:*

*Attesting Officer*

BRUCE LEHMAN

*Commissioner of Patents and Trademarks*